US012546178B2

(12) United States Patent
Nguyen

(10) Patent No.: US 12,546,178 B2
(45) Date of Patent: Feb. 10, 2026

(54) SPLIT HOUSING CONNECTOR ASSEMBLY FOR A WELLHEAD

(71) Applicant: Cameron International Corporation, Houston, TX (US)

(72) Inventor: Dennis P. Nguyen, Houston, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 18/679,547

(22) Filed: May 31, 2024

(65) Prior Publication Data

US 2025/0369304 A1 Dec. 4, 2025

(51) Int. Cl.
*E21B 33/04* (2006.01)

(52) U.S. Cl.
CPC ..... *E21B 33/04* (2013.01)

(58) Field of Classification Search
CPC .... E21B 33/04; E21B 33/0415; E21B 33/043; E21B 33/03
See application file for complete search history.

(56) References Cited

U.S. PATENT DOCUMENTS

| | | | | |
|---|---|---|---|---|
| 5,002,131 | A * | 3/1991 | Cromar | E21B 33/04 166/208 |
| 5,342,066 | A | 8/1994 | Henley | |
| 2017/0361445 | A1 | 12/2017 | Kahra | |
| 2023/0132558 | A1* | 5/2023 | Cheng | E21B 33/04 166/379 |
| 2023/0193726 | A1 | 6/2023 | Navar | |
| 2023/0212922 | A1* | 7/2023 | Wright | E21B 23/01 285/123.1 |
| 2023/0228165 | A1* | 7/2023 | Cheng | E21B 33/04 166/382 |

* cited by examiner

*Primary Examiner* — Giovanna Wright
(74) *Attorney, Agent, or Firm* — Kyle R. Miiller

(57) ABSTRACT

A split housing connector assembly for a wellhead housing includes a housing portion, a connector portion, and multiple fasteners configured to couple the housing portion and the connector portion to one another. The connector portion includes at least one tapered portion to enable the multiple fasteners to be within an outer diameter of the connector portion while the multiple fasteners couple the housing portion and the connector portion to one another.

18 Claims, 6 Drawing Sheets

SPLIT HOUSING CONNECTOR ASSEMBLY FOR A WELLHEAD

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Natural resources, such as oil and gas, are used as fuel to power vehicles, heat homes, and generate electricity. Once a desired natural resource is discovered below a surface of the earth, mineral extraction systems are often employed to access and extract the desired natural resource. The mineral extraction systems may be located onshore or offshore depending on the location of the desired natural resource. The mineral extraction systems generally include a wellhead through which the desired natural resource is extracted. The wellhead may include or be coupled to a wide variety of components, such as a tubing hanger that supports a tubing, a casing hanger that supports a casing, valves, fluid conduits, and the like.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In certain embodiments, a split housing connector assembly for a wellhead housing includes a housing portion, a connector portion, and multiple fasteners configured to couple the housing portion and the connector portion to one another. The connector portion includes at least one tapered portion to enable the multiple fasteners to be within an outer diameter of the connector portion while the multiple fasteners couple the housing portion and the connector portion to one another.

In certain embodiments, a wellhead housing includes a hanger configured to support a casing within the wellhead housing and a lock ring configured to lock the hanger within the wellhead housing. The wellhead housing also includes a split housing connector assembly with a housing portion comprising a shoulder configured to support the hanger, a connector portion comprising a corresponding groove configured to receive the lock ring, and a plurality of fasteners configured to couple the housing portion and the connector portion to one another.

In certain embodiments, a method includes landing a split housing connector assembly on one or more additional housing portions to form a wellhead housing. The method also includes running a hanger that supports a casing toward the split housing connector assembly. The method further includes, in response to identifying occurrence of an event, separating a connector portion of the split housing connector assembly from the housing portion of the split housing connector assembly.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

Figure 1:
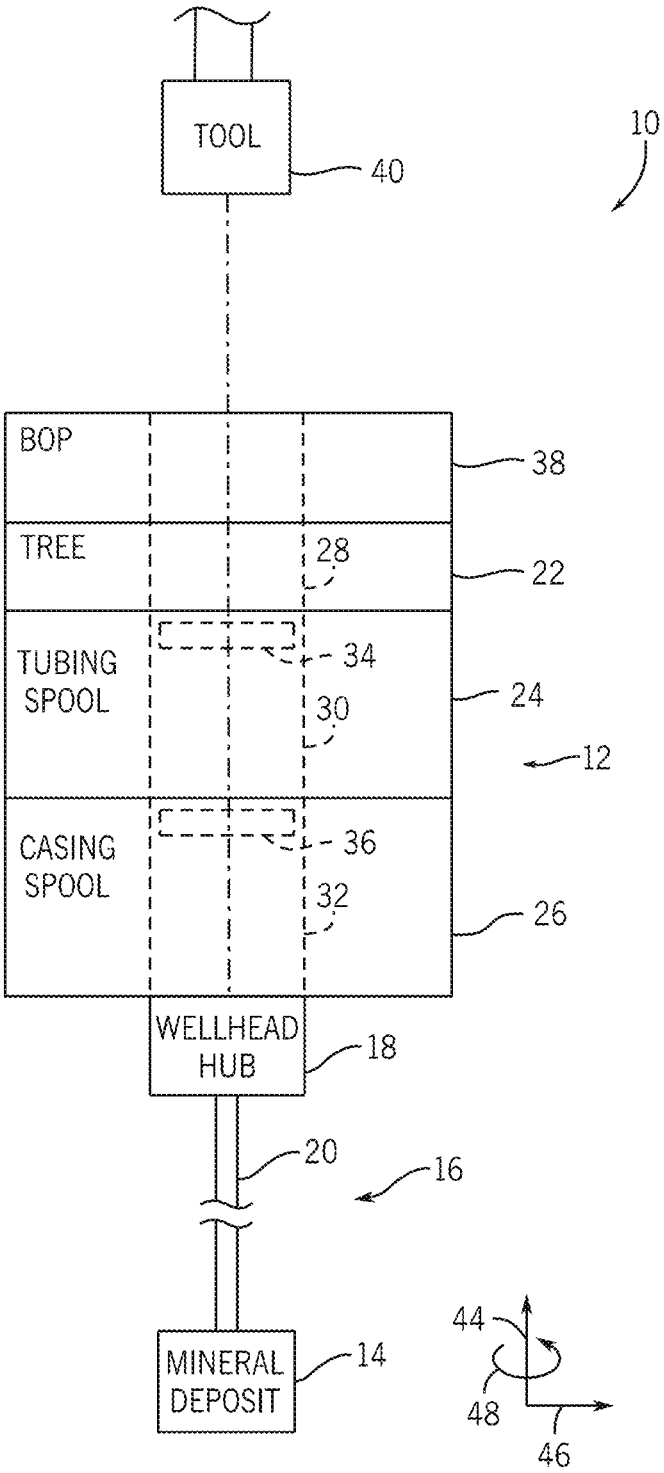
FIG. 1 is a block diagram of a mineral extraction system, in accordance with an embodiment of the present disclosure.

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Certain embodiments of the present disclosure generally relate to a split housing connector assembly for a wellhead. The split housing connector assembly may be a multi-piece structure that fits within a blowout preventer (BOP) stack (e.g., diverter) and that may transition between an engaged configuration and a disengaged configuration to support efficient casing installation operations. For example, the split housing connector assembly may include a housing portion and a connector portion that are coupled together via fasteners (e.g., threaded fasteners, such as bolts).

The split housing connector assembly may be in the engaged configuration within the BOP stack, and advantageously, the split housing connector assembly has a slim diameter in the engaged configuration to enable the split housing connector assembly to fit within the BOP stack. The split housing connector assembly may transition from the engaged configuration to the disengaged configuration via adjusting (e.g., unthreading) the fasteners to separate the housing portion from the connector portion, and advantageously, a slip may be run through the housing portion to efficiently address issues with casing operations (e.g., casing stuck in a wellbore) without use of an internal cutter, for example.

Certain embodiments of the present disclosure include one or more passages formed in (e.g., through or along) the split housing connector assembly and/or a hanger (e.g., hanger body) that supports the casing. The one or more passages are selectively sealed via a seal assembly (e.g., movable seal component). Thus, the seal assembly may selectively enable or block a flow of fluid across the hanger (e.g., axially across the hanger). In particular, during cementing operations, the seal assembly may be positioned to enable the flow of fluid through the one or more passages. Then, after the cementing operations, the seal assembly may be positioned to block the flow of fluid through the one or more passages (e.g., to seal the one or more passages). Advantageously, this configuration enables the seal assembly to run with the hanger into the wellhead (e.g., rather than running the hanger into the wellhead, then conducting cementing operations, and then running the seal assembly into the wellhead). However, it should be appreciated that the split housing connector assembly may be implemented in the wellhead having any of a variety of configurations, including without the one or more passages and/or with a separate seal assembly that is run separately (e.g., after) the hanger, for example.

With the foregoing in mind, FIG. 1 is a block diagram of an embodiment of a mineral extraction system 10. The mineral extraction system 10 may be utilized to access and/or extract various natural resources (e.g., hydrocarbons, such as oil and/or natural gas) from the earth. As illustrated, the mineral extraction system 10 includes a wellhead 12 (e.g., annular wellhead) coupled to a mineral deposit 14 via a well 16. The well 16 may include a wellhead hub 18 (e.g., annular wellhead hub) and a wellbore 20. The wellhead hub 18 generally includes a large diameter hub disposed at an end of the wellbore 20 and is configured to connect the wellhead 12 to the wellbore 20. As will be appreciated, the wellbore 20 may contain elevated pressures. For example, the wellbore 20 may include pressures that exceed 10,000, 15,000, or even 20,000 pounds per square inch (psi). Accordingly, the mineral extraction system 10 may employ various mechanisms, such as seals, plugs, and valves, to control and regulate the well 16.

In the illustrated embodiment, the mineral extraction system 10 includes a tree 22, a tubing spool 24, a casing spool 26, and a blowout preventer (BOP) 38. The tree 22 generally includes a variety of flow paths (e.g., bores), valves, fittings, and controls for operating the well 16. Further, the tree 22 may provide fluid communication with the well 16. For example, the tree 22 includes a tree bore 28 that provides for completion and workover procedures, such as the insertion of tools (e.g., a tool 40) into the well 16, the injection of various chemicals into the well 16, and so forth. Further, the natural resources extracted from the well 16 may be regulated and routed via the tree 22. For example, the tree 22 may be coupled to a flowline that is tied back to other components, such as a manifold.

As shown, the tubing spool 24 may provide a base for the tree 22 and includes a tubing spool bore 30 that connects (e.g., enables fluid communication between) the tree bore 28 and the well 16. As shown, the casing spool 26 may be positioned between the tubing spool 24 and the wellhead hub 18 and includes a casing spool bore 32 that connects (e.g., enables fluid communication between) the tree bore 28 and the well 16. Thus, the tubing spool bore 30 and the casing spool bore 32 may provide access to the wellbore 20 for various completion and workover procedures. The BOP 38 may consist of a variety of valves, fittings, and controls to block oil, gas, or other fluid from exiting the well 16 in the event of an unintentional release of pressure or an overpressure condition.

As shown, a tubing hanger 34 is positioned within the tubing spool 24. The tubing hanger 34 may be configured to support tubing (e.g., a tubing string) that is suspended in the wellbore 20 and/or to provide a path for control lines, hydraulic control fluid, chemical injections, and so forth. Additionally, as shown, a casing hanger 36 is positioned within the casing spool 26. The casing hanger 36 may be configured to support casing (e.g., a casing string) that is suspended in the wellbore 20. The tool 40 may be utilized to lower the tubing hanger 34 into the tubing spool 24 and/or the casing hanger 36 into the casing spool 26.

As discussed in more detail herein, a portion of the casing spool 26 may include or be formed by a split housing connector assembly, which may be a multi-piece structure that fits within a blowout preventer (BOP) stack (e.g., diverter) and that may transition between an engaged configuration and a disengaged configuration to support efficient casing installation operations. To facilitate discussion, the mineral extraction system 10, and the components therein, may be described with reference to an axial axis or direction 44, a radial axis or direction 46, and a circumferential axis or direction 48.

Figure 2:
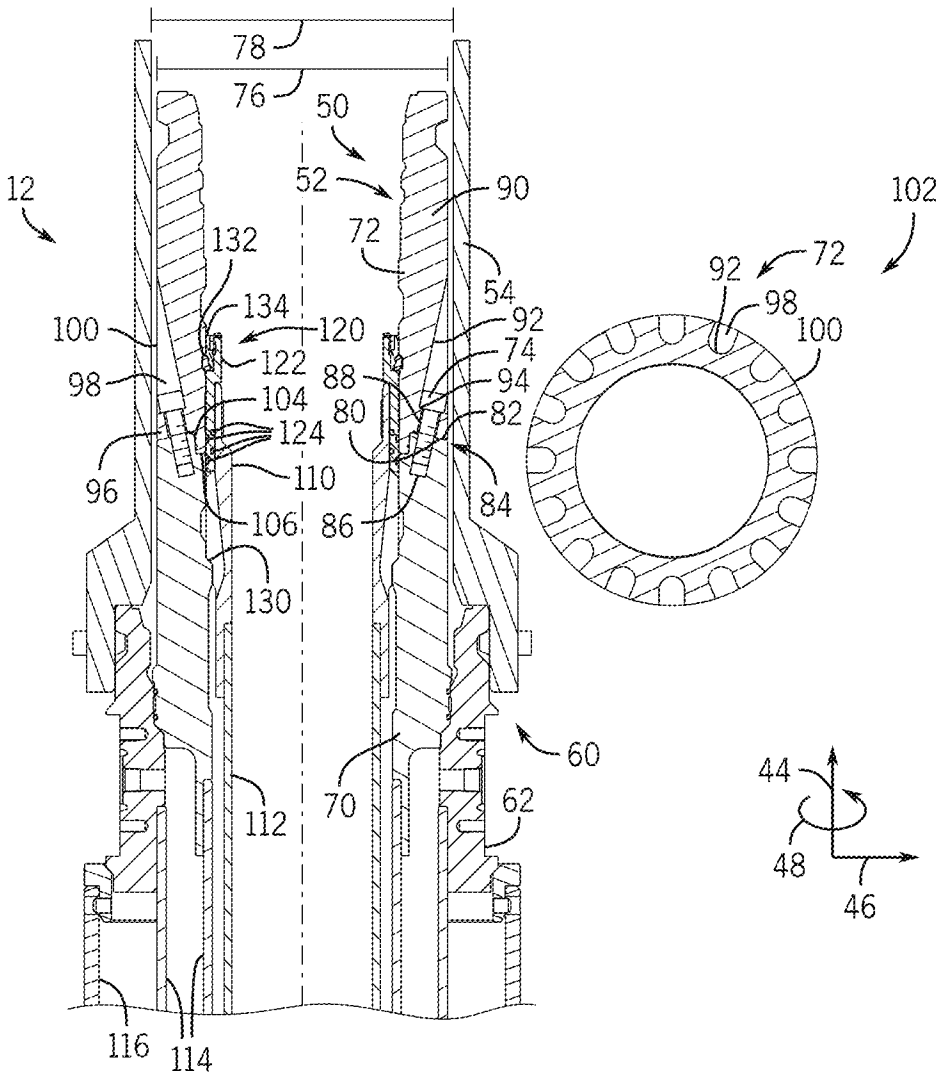
FIG. 2 is a cross-sectional side view of an embodiment of a portion of a wellhead that may be utilized in the mineral extraction system of FIG. 1, wherein a split housing connector assembly is in an engaged configuration and is positioned within a blowout preventer (BOP) stack.

FIG. 2 is a cross-sectional side view of an embodiment of a portion of the wellhead 12 that may be utilized in the mineral extraction system 10 of FIG. 1, wherein a split housing connector assembly 50 (e.g., annular split housing connector assembly) is in an engaged configuration 52 and is positioned within a blowout preventer (BOP) stack 54 (e.g., diverter). The split housing connector assembly 50 may form a portion of a wellhead housing 60 (e.g., a portion of a casing spool, such as a portion of the casing spool 26 of FIG. 1). For example, the split housing connector assembly 50 may be supported on one or more additional portions 62 (e.g., annular additional portions) of the wellhead housing 60.

The split housing connector assembly 50 includes a housing portion 70 (e.g., annular housing portion) and a connector portion 72 (e.g., annular connector portion) coupled to one another via fasteners 74 (e.g., threaded fasteners, such as bolts). The housing portion 70 and the connector portion 72 are annular structures, and the fasteners 74 are distributed circumferentially about the housing portion 70 and the connector portion 72. As shown, the housing portion 70 and the connector portion 72 include features that enable the fasteners 74 to join the housing portion 70 to the connector portion 72 in a manner that provides an outer diameter 76 (e.g., maximum outer diameter) for the split housing connector assembly 50 that is less than an inner diameter 78 of the BOP stack 54. Thus, the split housing connector assembly 50 may fit within the BOP stack 54.

In certain embodiments, the housing portion 70 may include a first housing surface 80 (e.g., upper surface) and the connector portion 72 may include a first connector surface 82 (e.g., lower surface) that contact one another at an interface 84. As shown, the first housing surface 80 and the first connector surface 82 may be angled relative to the axial axis 44. For example, a radially inner edge of the first housing surface 80 may be further from the well along the axial axis 44 as compared to a radially outer edge of the first housing surface 80, and a radially inner edge of the first connector surface 82 may be further from the well along the axial axis 44 as compared to a radially outer edge of the first connector surface 82.

The connector portion 72 may also include a connector body 90 with tapered portions 92 (e.g., grooves; tapered wall portion). For example, the tapered portions 92 may taper toward the well such that an axially upper end of a respective tapered portion 92 is positioned radially outward relative to an axially lower end of the respective tapered portion 92. The axially lower end of the respective tapered portion 92 may extend to a respective second connector surface 94 that extends radially outward from the axially lower end of the respective tapered portion 92. Further, the respective second connector surface 94 may be angled relative to the axial axis 44. For example, a radially inner edge of the respective second connector surface 94 may be further from the well along the axial axis 44 as compared to a radially outer edge of the respective second connector surface 94. The tapered portions 92, the second connector surfaces 94, and the first connector surface 82 may form radial extensions 96 (e.g., tab; angled extensions), which may form or be part of an annular base or structure of the connector portion 72.

As shown, multiple recesses 86 (e.g., threaded recesses) may be formed in the first housing surface 80 (e.g., distributed circumferentially about the first housing surface 80). Further, multiple openings 88 (e.g., threaded openings) may be formed through the radial extensions 96 (e.g., each open to and extending between the first connector surface 82 and a respective second connector surfaces 94; distributed circumferentially about the radial extensions 96). Each of the multiple recesses 86 aligns with a corresponding one of the multiple openings 88 to enable insertion of a corresponding one of the fasteners 74. Accordingly, the fasteners 74 may extend through the multiple openings 88 and into the multiple recesses 86 to couple the housing portion 70 and the connector portion 72 to one another.

Additionally, the multiple recesses 86 and the multiple openings 88 are also angled (e.g., acute angle) relative to the axial axis 44 and the radial axis 46 and cause the fasteners 74 to be angled (e.g., acute angle) relative to the axial axis 44 and the radial axis 46 when the fasteners 74 are in place to couple the housing portion 70 and the connector portion 72 to one another. For example, a radially outer edge of a respective fastener 74 may be further from the well along the axial axis 44 as compared to a radially inner edge of the respective fastener 74. Thus, the fasteners 74 are not placed to extend along the axial axis 44 (e.g., axially or vertically; not parallel to the axial axis) and are not placed extend along the radial axis 46 (e.g., radially or horizontally; not parallel to the radial axis 46). While the fasteners 74 are shown to be angled about 30 degrees relative to the axial axis 44 in FIG. 2, it should be appreciated that the fasteners 74 may be at any suitable angle relative to the axial axis 44 (e.g., between about 15 to 75, 25 to 65, or 35 to 55 degrees).

Due to geometry of the housing portion 70 and the connector portion 72 as described herein, the fasteners 74 may fit within radial gaps 98 (e.g., grooves) defined by the tapered portions 92. As a result, the fasteners 74 may not extend radially outward beyond an outer wall 100 of the connector portion 72 and may not extend radially outward beyond the outer diameter 76 of the split housing connector assembly 50. An inset 102 in FIG. 2 illustrates a schematic cross-sectional view through the connector portion 72 at the radial gap 98. To facilitate discussion and image clarity, not all portions of the connector portion 72 are included in the inset 102; however, the inset 102 illustrates that the tapered portions 92 are distributed circumferentially about the connector portion 72 to provide the radial gaps 98 for the fasteners 74 at spaced apart locations circumferentially about the connector portion 72. While multiple tapered portions 92 define multiple radial gaps 98 spaced evenly about the connector portion 72 and one fastener 74 per radial gap 98, it should be appreciated that any suitable arrangement and/or or number of tapered portions 92 and radial gaps 98, as well as fasteners 74 per radial gap 98, may be provided in the split housing connector assembly 50 (e.g., uneven spacing; multiple fasteners 74 per radial gap 98).

As shown, the connector portion 72 also includes an axial seal extension 104 that may facilitate engagement and sealing between the housing portion 70 and the connector portion 72. For example, the axial seal extension 104 may extend axially into an annular seat 106 defined by the housing portion 70, as well as axially toward the well relative to the first connector surface 82, the first housing surface 80, and the interface 84. As discussed in more detail below with respect to FIG. 5, the axial seal extension 104 may support a connector seal assembly with one or more seal elements in one or more seal grooves to form a seal (e.g., block fluid flow) between the housing portion 70 and the connector portion 72.

The split housing connector assembly 50 may support a hanger 110 (e.g., annular hanger; a casing hanger, such as the casing hanger 36 of FIG. 1). The hanger 110 may be positioned in the wellhead housing 60 and suspends a casing 112 (e.g., annular casing) that extends into a wellbore. For example, the casing 112 may pass through one or more additional casings 114 and/or a conductor 116 to extend into the wellbore. A seal assembly 120 (e.g., annular seal assembly) is positioned about a portion of the hanger 110. As shown, the seal assembly 120 may include a seal body 122 (e.g., annular seal body; ring; a one-piece, solid body) that defines one or more inner seal grooves (e.g., annular seal grooves) that support one or more seal elements 124 (e.g., annular seal elements).

In operation, a running tool may lower the hanger 110 with the casing 112 and the seal assembly 120 into the wellhead housing 60. With reference to FIG. 2, the running tool may lower the hanger 110 until the hanger 110 reaches a landed position in which the hanger 110 is landed on a shoulder 130 (e.g., annular shoulder) of the housing portion 70 (e.g., axially facing or radially overlapping surfaces contact one another to block further movement of the hanger 110 relative to the wellhead housing 60 toward the wellbore). The seal assembly 120 may also be locked into place via a lock ring 132 (e.g., c-shaped ring). In FIG. 2, the lock ring 132 is driven and/or held into a corresponding groove of the connector portion 72 via a push ring 134 (e.g., annular ring). However, it should be appreciated that the split housing connector assembly 50 described herein may be implemented with any of a variety of hangers and/or seal assemblies.

Figure 3:
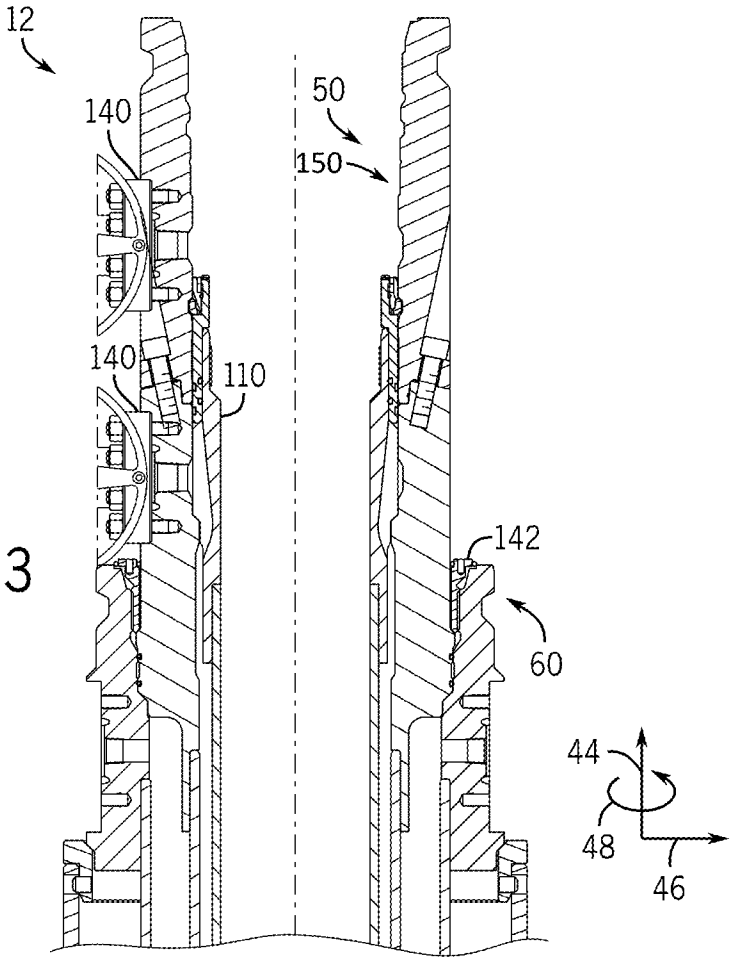
FIG. 3 is a cross-sectional side view of an embodiment of the portion of the wellhead of FIG. 2, wherein the split housing connector assembly is in the engaged configuration and is retained to the wellhead.

FIG. 3 is a cross-sectional side view of an embodiment of the portion of the wellhead 12 of FIG. 2, wherein the split housing connector assembly 50 is in the engaged configuration 52 and is retained to the wellhead 12. In FIG. 3, valve assemblies 140 are coupled to the split housing connector assembly 50 (e.g., instead of presence of the BOP stack 54 of FIG. 2). It should be appreciated that, once the hanger 110 is properly landed and sealed within the wellhead housing 60 (e.g., the split housing connector assembly 50 of the wellhead housing 60), the valves assembly 140 may then be coupled to the split housing connector assembly 50 (e.g., after removal of the BOP stack 54 of FIG. 2). In certain embodiments, a retainer ring 142 may be provided about the split housing connector assembly 50 to retain the split housing connector assembly 50 to the wellhead 12.

Figure 4:
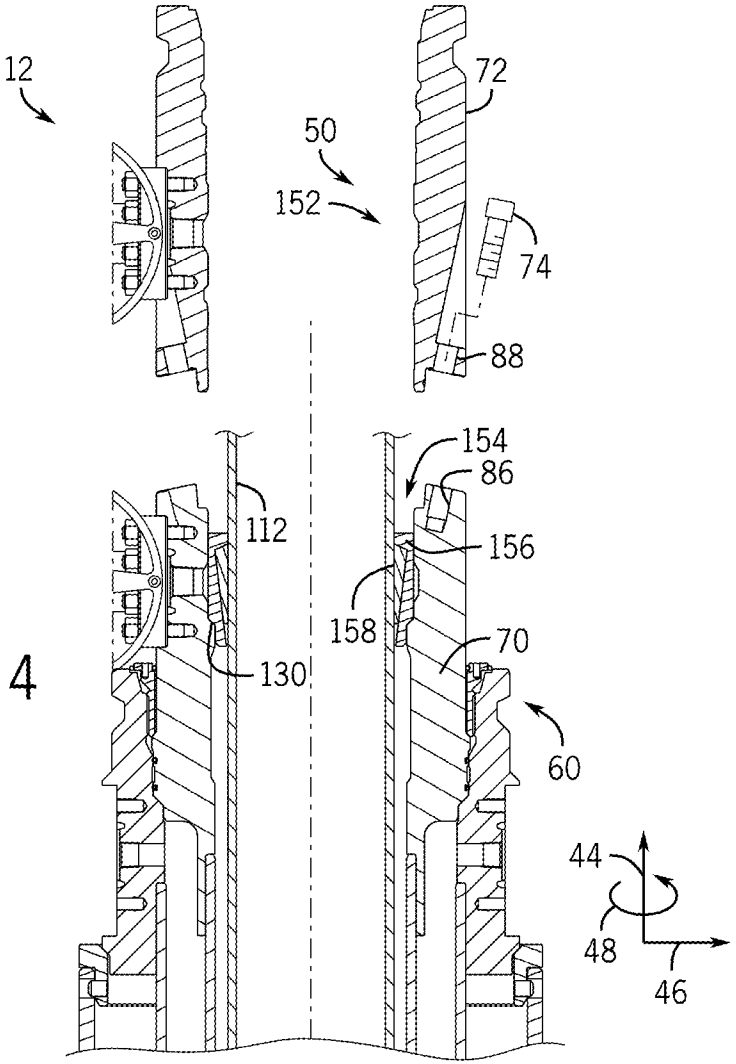
FIG. 4 is a cross-sectional side view of an embodiment of the portion of the wellhead of FIG. 2, wherein the split housing connector assembly is in a disengaged configuration to facilitate placement of a slip.

FIG. 4 is a cross-sectional side view of an embodiment of the portion of the wellhead 12 of FIG. 2, wherein the split housing connector assembly 50 is in a disengaged configuration 152 to facilitate placement of a slip 154 (e.g., slip hanger; annular hanger). In operation, it may be desirable to efficiently adjust the split housing connector assembly 50 from the engaged configuration 150 of FIG. 3 to the disengaged configuration 152 of FIG. 4 in certain circumstances and/or in response to certain events, such as in response to the casing 112 becoming stuck in the wellbore (e.g., blocking proper landing of the hanger 110, as shown in FIG. 3).

To achieve this transition to the disengaged configuration 152, the fasteners 74 may be removed (e.g., unthreaded, loosened, and/or withdrawn) from the multiple recesses 86 and the multiple openings 88. Advantageously, the fasteners 74 may be accessible from an exterior of the split housing connector assembly 50 (e.g., to allow an operator to access the fasteners 74), such as even while the fasteners 74 coupled the housing portion 70 and the connector portion 72 to one another. As described herein, an angle (e.g., orientation) of the fasteners 74 may facilitate access, a slim profile (e.g., the outer diameter 76 of FIG. 2), as well as sufficient strength for a connection between the housing portion 70 and the connector portion 72.

Once the fasteners 74 are removed, the connector portion 72 may be moved relative to the housing portion 70 to separate from the housing portion 70. In turn, this may provide access to the casing 112 and/or other components within the wellhead housing 60. For example, this may provide access to place the slip 154 about the casing 112 within the wellhead housing 60. As shown, the slip 154 may include a slip bowl 156 and slip segments 158 that extend circumferentially about the casing 112 to hold the casing 112, and the slip 154 may be supported on the shoulder 130 of the housing portion 70 of the split housing connector assembly 50. In certain embodiments, the valves assemblies 140 may remain in place in the disengaged configuration 152; however, it should be appreciated that other operations are envisioned, including operations in which the valve assemblies 140 are removed in the disengaged configuration 152. If desired, the connector portion 72 may then be recoupled to the housing portion 70 after installation of the slip 154. Alternatively, another type of connector portion or housing portion may be coupled to the housing portion 70 after installation of the slip 154.

Figure 5:
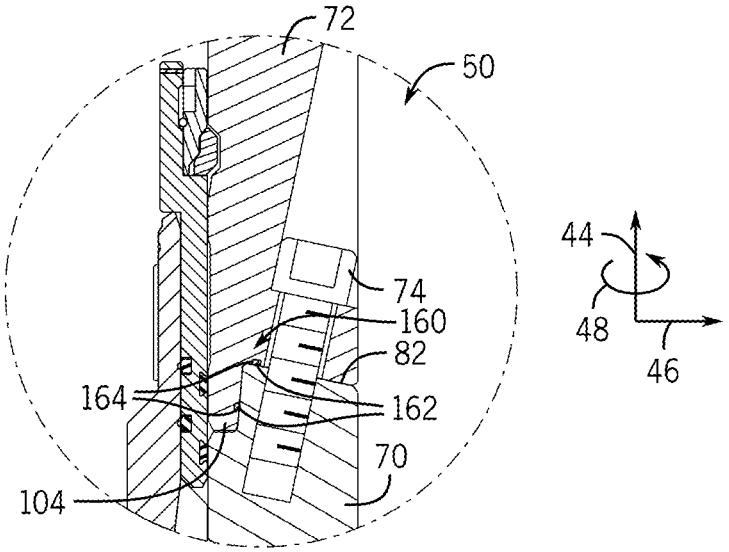
FIG. 5 is cross-sectional side view of an embodiment of a portion of a connector seal assembly of the split housing connector assembly, wherein the connector seal assembly includes multiple annular seal elements in respective seal grooves.

FIG. 5 is cross-sectional side view of an embodiment of a portion of a connector seal assembly 160 of the split housing connector assembly 50, wherein the connector seal assembly 160 includes multiple annular seal elements 162 in respective seal grooves 164. The multiple annular seal elements 162 provide a seal between the connector portion 72 and the housing portion 70 of the split housing connector assembly 50. Additionally, as shown, the multiple annular seal elements 162 may be positioned along and/or proximate to the axial seal extension 104 of the connector portion 72, and the multiple annular seal elements 162 may be positioned radially inward of the fasteners 74.

While the multiple annular seal elements 162 include one seal element supported along a radially outer surface of the axial seal extension 104 and one seal element supported along the first connector surface 82, it should be appreciated that the multiple annular seal elements 162 may include any suitable number of annular seal elements (e.g., 1, 2, 3, 4, 5, or more) in any suitable position between the housing portion 70 and the connector portion 72 (e.g., supported in respective seal grooves formed in the housing portion 70, multiple annular seal elements along any one surface, and so forth).

Figure 6:
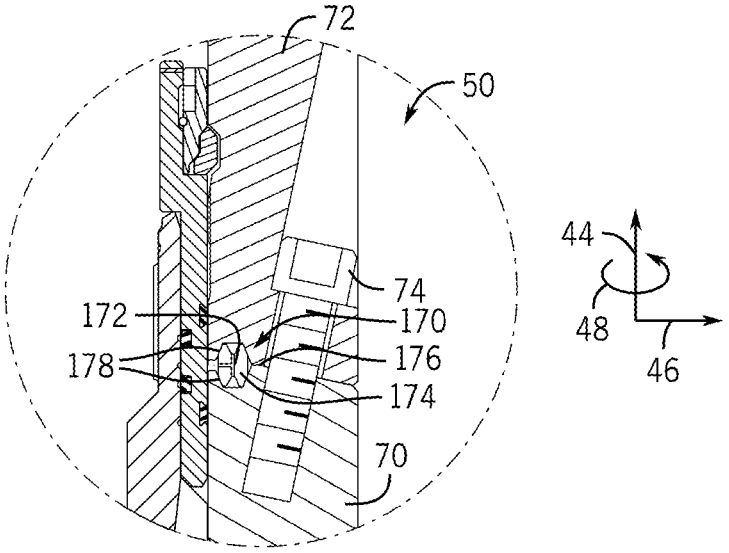
FIG. 6 is cross-sectional side view of an embodiment of a portion of a connector seal assembly of the split housing connector assembly, wherein the connector seal assembly includes a pressure energizing member.

FIG. 6 is cross-sectional side view of an embodiment of a portion of a connector seal assembly 170 of the split housing connector assembly 50, wherein the connector seal assembly 170 includes a pressure energizing member 172 (e.g., a biased member; a spring member). As shown, the connector seal assembly 170 includes at least one annular seal element 174 to provide a seal between the connector portion 72 and the housing portion 70 of the split housing connector assembly 50, and the at least one annular seal element 174 includes and/or is driven by the pressure energizing member 172. Additionally, as shown, the at least one annular seal element 174 with the pressure energizing member 172 may be positioned along an interface 176 (e.g., formed at or across axially-facing surfaces) between the connector portion 72 and the housing portion 70, may be supported in seal grooves 178, and/or may be positioned radially inward of the fasteners 74.

While only one annular seal element 174 with only one pressure energizing member 172 is shown in FIG. 6, it should be appreciated that any suitable number of annular seal elements and/or pressure energizing members (e.g., 1, 2, 3, 4, 5, or more) may be provided in any suitable position between the housing portion 70 and the connector portion 72 (e.g., multiple annular seal elements along any one surface and/or multiple surfaces, and so forth).

Figure 7:
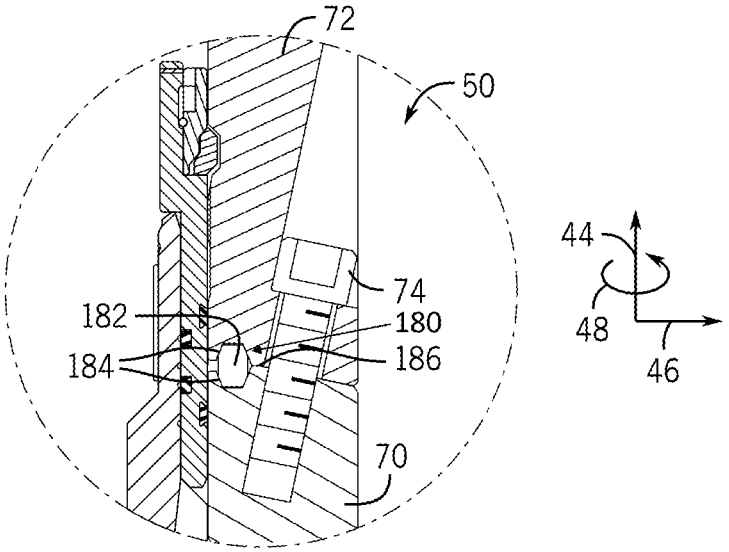
FIG. 7 is cross-sectional side view of an embodiment of a portion of a connector seal assembly of the split housing connector assembly, wherein the connector seal assembly includes an annular seal element in a seal groove.

FIG. 7 is cross-sectional side view of an embodiment of a portion of a connector seal assembly 180 of the split housing connector assembly 50, wherein the connector seal assembly 180 includes an annular seal element 182 in seal grooves 184. As shown, the connector seal assembly 180 includes the annular seal element 182 to provide a seal between the connector portion 72 and the housing portion 70 of the split housing connector assembly 50. Additionally, as shown, the annular seal element 182 may be positioned along an interface 186 (e.g., formed at or across axially-facing surfaces) between the connector portion 72 and the housing portion 70 and/or may be positioned radially inward of the fasteners 74.

While only one annular seal element 182 is shown in FIG. 7, it should be appreciated that any suitable number of annular seal elements (e.g., 1, 2, 3, 4, 5, or more) may be provided in any suitable position between the housing portion 70 and the connector portion 72 (e.g., multiple annular seal elements along any one surface and/or multiple surfaces, and so forth).

Figure 8:
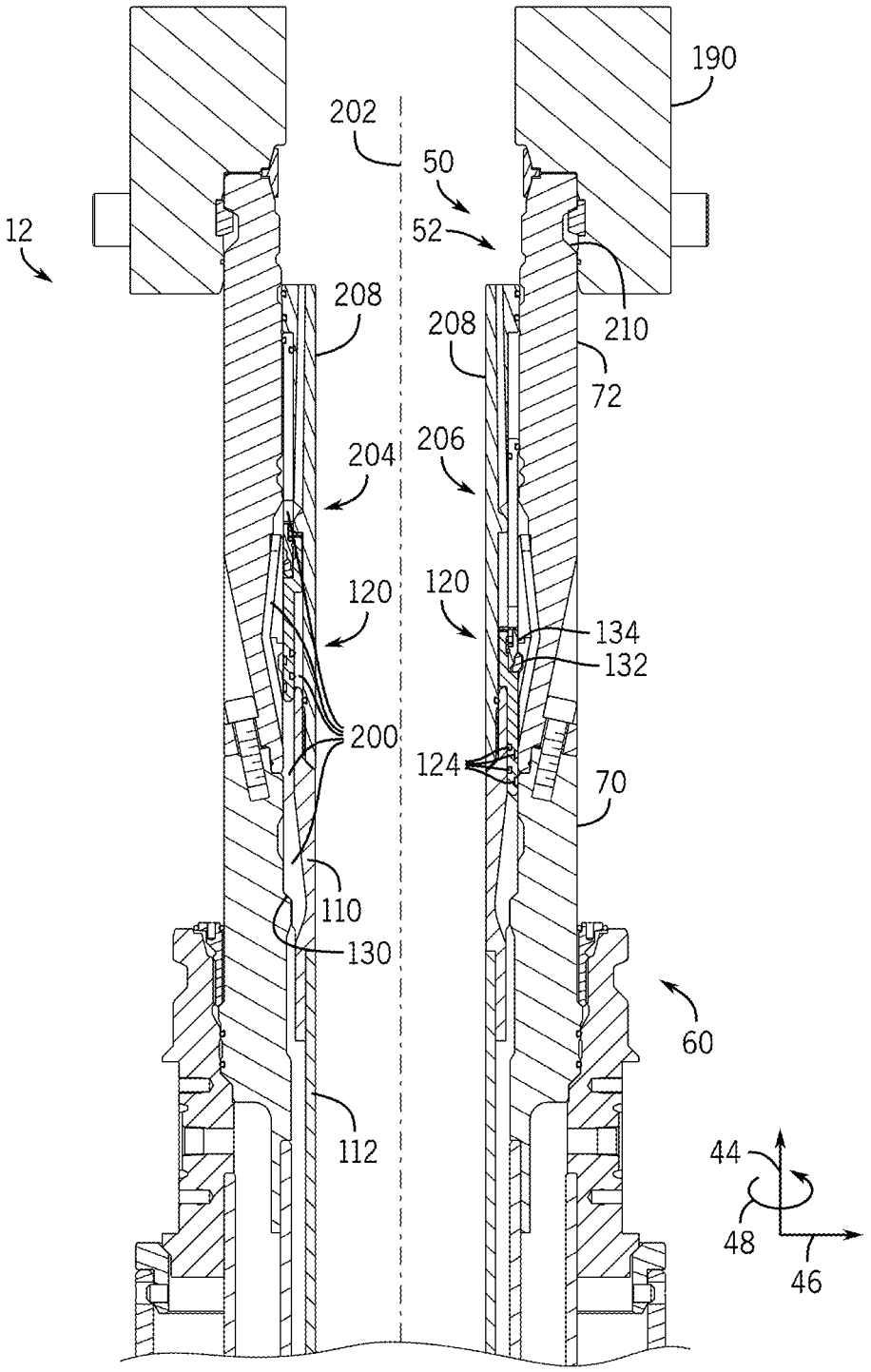
FIG. 8 is a cross-sectional side view of an embodiment of a portion of the wellhead of FIG. 2, wherein the split housing connector assembly is in the engaged configuration and is retained to the wellhead and a tubing spool.

FIG. 8 is a cross-sectional side view of an embodiment of a portion of the wellhead 12 of FIG. 2, wherein the split housing connector assembly 50 is in the engaged configuration 52 and is retained to the wellhead 12. FIG. 8 illustrates additional features and components that may be implemented with the split housing connector assembly 50. For example, one or more passageways 200 may be utilized to facilitate cementing operations in conjunction with the split housing connector assembly 50. As shown, on a first side of a center axis 202 of FIG. 8, the seal assembly 120 is in a first position 204 (e.g., unsealed position; flowby position). While the hanger 110 is landed on the shoulder 130 and the seal assembly 120 is in the first position 204, the one or more passageways 200 may enable fluid flow from a first axial location below the hanger 110 to a second axial location above the hanger 110 (e.g., relative to the wellbore). In this way, the one or more passageways 200 enable cement returns to flow from an annular space (e.g., between the casing 112 and the housing portion 70 of the wellhead housing 60) at the first axial location below the hanger 110 to the second axial location above the hanger 110. It should be appreciated that all or some of the one or more passageways 200 (e.g., through the connector portion 72, along a radially outer surface of the running tool 208, and/or any combination thereof) shown in FIG. 8 may be provided to facilitate these techniques.

As shown, on a second side of the center axis 202 of FIG. 8, the seal assembly 120 is in a second position 206 (e.g., sealed position). While the hanger 110 is landed on the shoulder 130 and the seal assembly 120 is in the second position 206, the one or more seal elements 124 seal between the hanger 110 and the split housing connector assembly 50 block fluid flow through the one or more passageways 200 from the first axial location below the hanger 110 to the second axial location above the hanger 110. In FIG. 8, the seal assembly 120 is moved from the first position 204 to the second position 206 via a running tool 208 that drives the seal assembly 120 to move axially relative to the hanger 110, as well as drives the push ring 134 to cause the lock ring 132 to engage the corresponding groove of the connector portion 72 of the split housing connector assembly 50. It should be appreciated that the running tool 208 may be withdrawn after the seal assembly 120 is in the second position 206. As another example, as shown in FIG. 8, a connected structure 190 (e.g., tubing spool) may be coupled to the connector portion 72 of the split housing connector assembly 50, such as to one or more outer recesses 210 after successfully landing the hanger 110 and installing the casing 112 within the wellbore.

Figure 9:
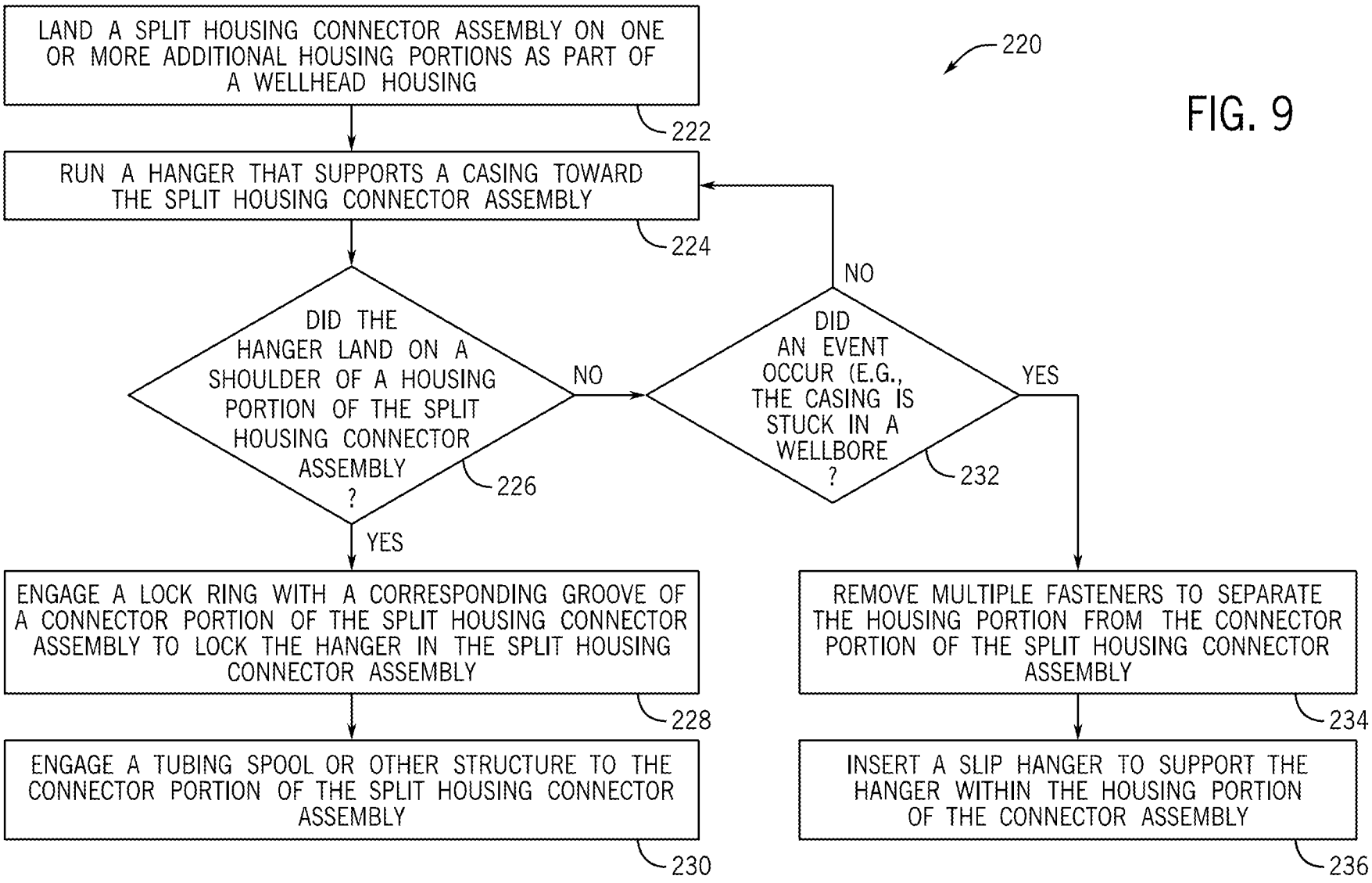
FIG. 9 is a flow diagram of an embodiment of a method of operating a split housing connector assembly.

FIG. 9 is a flow diagram of an embodiment of a method 220 of operating a split housing connector assembly (e.g., the split housing connector assembly 50 of FIGS. 2-8). The method 220 disclosed herein includes various steps represented by blocks. Although the flow chart illustrates the steps in a certain sequence, it should be understood that the steps may be performed in any suitable order and certain steps may be carried out simultaneously, where appropriate.

In block 222, the method 220 may begin with landing a split housing connector assembly on one or more additional housing portions as part of a wellhead housing. The split housing connector assembly may include a housing portion and a connector portion coupled to one another via fasteners, and the split housing connector assembly may be sized to fit through a BOP stack.

In block 224, the method 220 may continue with running a hanger that supports a casing toward the split housing connector assembly that is part of the wellhead housing. In certain embodiments, the method 220 may also include running a seal assembly with the hanger to facilitate efficient cementing and sealing operations, for example.

In block 226, the method 220 may continue with determining whether the hanger landed on a shoulder of the housing portion of the split housing connector assembly. In response to determining that the hanger landed on the shoulder of the housing portion of the split housing connector assembly, the method 220 may continue to block 228 to engage a lock ring with a corresponding groove of the connector portion of the split housing connector assembly to lock the hanger in the split housing connector assembly.

As described herein, cementing operations may be carried out to cement the casing within a wellbore after the hanger is landed on the shoulder of the housing portion of the split housing connector assembly and prior to engaging the lock ring with the corresponding groove of the connector portion of the split housing connector assembly to lock the hanger in the split housing connector assembly. Further, as described herein, the seal assembly may be run with the hanger or inserted at some other suitable time after the hanger is landed on the shoulder of the housing portion of the split housing connector assembly and prior to engaging the lock ring with the corresponding groove of the connector portion of the split housing connector assembly to lock the hanger in the split housing connector assembly. In this way, the casing may be cemented in place within the wellbore, an annular space below the hanger may be sealed and isolated from above the hanger, and the hanger may be locked in place as well. As shown, in block 230, the method 220 may continue with engaging (e.g., connecting) a tubing spool or other structure to the connector portion of the split housing connector assembly, such as to enable the tubing spool to form part of the wellhead housing and to support tubing strings, seals, and so forth, for various operations within the wellbore.

Returning to block 226, in response to determining that the hanger is not landed on the shoulder of the housing portion of the split housing connector assembly, the method 220 may continue to block 232 to identify occurrence of an event (e.g., the casing is stuck in the wellbore). However, in response to determining no occurrence of an event, the method 220 may return to block 224 to continue to run the hanger that supports the casing toward the split housing connector assembly. However, in response to determine occurrence of an event (e.g., the casing is stuck in the wellbore), the method 220 may continue to block 234 to remove multiple fasteners to separate the housing portion from the connector portion of the split housing connector assembly (e.g., adjusting the split housing connector assembly from an engaged configuration to a disengaged configuration). For example, an operator may remove (e.g., unthread, loosen, and/or withdraw) the multiple fasteners and then separate (e.g., lift, move) the connector portion of the split housing connector assembly from the housing portion of the split housing connector assembly.

In block 236, the method 220 may continue with inserting a slip hanger to support the casing within the housing portion of the connector assembly. As described herein, separation of the connector portion of the split housing connector assembly from the housing portion of the split housing connector assembly may enable the operator to install the slip hanger to land on the housing portion of the split housing connector assembly and to support the casing. Advantageously, efficient transition to the disengaged configuration may enable efficient installation of the slip hanger, as well avoid use of internal cutters, for example. As described herein, the connector portion may then be reconnected to the housing portion, or some other portion may be connected to the housing portion to complete the wellhead housing, for example.

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the invention as defined by the following appended claims. For example, while the illustrated embodiments show a hanger and a housing of a wellhead, it should be understood that the systems and methods may be adapted to for use with any of a variety of other annular structures. Additionally, any features shown or described with reference to FIGS. 1-9 may be combined in any suitable manner.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A split housing connector assembly for a wellhead housing, the split housing connector assembly comprising:
- a housing portion;
- a connector portion; and
- a plurality of fasteners configured to couple the housing portion and the connector portion to one another,
- wherein the connector portion comprises:
  - at least one tapered portion to enable the plurality of fasteners to be within an outer diameter of the connector portion while the plurality of fasteners couple the housing portion and the connector portion to one another; and
  - at least one connector surface that extends radially outward from an axially lower end of the at least one tapered portion, and the at least one connector surface comprises multiple openings to receive the plurality of fasteners.

2. The split housing connector assembly of claim 1, wherein the housing portion comprises a shoulder configured to support a hanger with a casing.

3. The split housing connector assembly of claim 2, wherein the connector portion comprises a groove configured to receive a lock ring to lock the hanger with the casing to the split housing connector assembly.

4. The split housing connector assembly of claim 1, wherein the connector portion comprises one or more outer recesses to couple to a tubing spool.

5. The split housing connector assembly of claim 1, wherein the connector portion comprises a first end portion that is configured to contact the housing portion while the plurality of fasteners couple the housing portion and the connector portion to one another, and the connector portion comprises a second end portion that is configured to couple to a tubing spool.

6. The split housing connector assembly of claim 1, wherein the at least one tapered portion comprises a plurality of tapered portions distributed circumferentially about the connector portion, and each tapered portion of the plurality of tapered portions is configured to receive a respective fastener of the plurality of fasteners.

7. The split housing connector assembly of claim 1, wherein each fastener of the plurality of fasteners is inserted into a respective recess of multiple recesses formed in the housing portion and a respective opening of the multiple openings formed in the connector portion to couple the housing portion and the connector portion to one another.

8. The split housing connector assembly of claim 1, wherein each fastener of the plurality of fasteners is positioned at an acute angle relative to an axial axis while the plurality of fasteners couple the housing portion and the connector portion to one another.

9. A wellhead housing, comprising:
- a hanger configured to support a casing within the wellhead housing;
- a lock ring configured to lock the hanger within the wellhead housing; and
- a split housing connector assembly, comprising:
  - a housing portion comprising a shoulder configured to support the hanger;
  - a connector portion comprising a corresponding groove configured to receive the lock ring; and
  - a plurality of fasteners configured to couple the housing portion and the connector portion to one another,
  - wherein the connector portion comprises at least one tapered portion to enable the plurality of fasteners to be within an outer diameter of the connector portion while the plurality of fasteners couple the housing portion and the connector portion to one another.

10. The wellhead housing of claim 9, wherein the connector portion comprises a first end portion that is configured to contact the housing portion while the plurality of fasteners couple the housing portion and the connector portion to one another, and the connector portion comprises a second end portion that is configured to couple to a tubing spool.

11. The wellhead housing of claim 10, wherein the at least one tapered portion comprises a plurality of tapered portions distributed circumferentially about the connector portion, and each tapered portion of the plurality of tapered portions is configured to receive a respective fastener of the plurality of fasteners.

12. The wellhead housing of claim 9, wherein each fastener of the plurality of fasteners is inserted into a respective recess of multiple recesses formed in the housing portion and a respective opening of multiple openings formed in the connector portion to couple the housing portion and the connector portion to one another.

13. The wellhead housing of claim 9, wherein each fastener of the plurality of fasteners is positioned at an acute angle relative to an axial axis while the plurality of fasteners couple the housing portion and the connector portion to one another.

14. The wellhead housing of claim 9, wherein the connector portion comprises at least one connector surface that extends radially outward from the at least one tapered portion, and the at least one connector surface comprises multiple openings to receive the plurality of fasteners.

15. The wellhead housing of claim 9, comprising a seal assembly configured to provide a seal between the hanger and the split housing connector assembly.

16. A method, comprising:
- landing a split housing connector assembly on one or more additional housing portions to form the wellhead housing of claim 9;
- running the hanger that supports the casing toward the split housing connector assembly; and
- in response to identifying occurrence of an event, separating the connector portion of the split housing connector assembly from the housing portion of the split housing connector assembly.

17. The method of claim 16, wherein separating the connector portion of the split housing connector assembly from the housing portion of the split housing connector assembly comprises removing the plurality of fasteners.

18. The method of claim 16, comprising installing a slip to support the casing within the housing portion of the split housing connector assembly.

* * * * *